US006781097B2

(12) United States Patent
Graff

(10) Patent No.: US 6,781,097 B2
(45) Date of Patent: Aug. 24, 2004

(54) SYSTEM AND METHOD FOR PROPORTIONAL CONTROL OF OVEN HEATING ELEMENTS

(75) Inventor: Timothy E. Graff, Crystal Lake, IL (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/320,866

(22) Filed: Dec. 16, 2002

(65) Prior Publication Data

US 2003/0116557 A1 Jun. 26, 2003

Related U.S. Application Data

(60) Provisional application No. 60/345,500, filed on Dec. 21, 2001.

(51) Int. Cl.[7] ..... H05B 1/02

(52) U.S. Cl. ..... 219/492; 219/486; 219/483; 219/508; 219/494; 219/414

(58) Field of Search ..... 219/483–486, 219/507–510, 481, 494, 492, 497, 505, 490, 491, 493, 506, 411–415, 702, 703, 720, 501; 126/396; 431/12, 78, 79; 99/325–333

(56) References Cited

U.S. PATENT DOCUMENTS

| | | | | |
|---|---|---|---|---|
| 2,832,878 A | | 4/1958 | Baird | |
| 3,258,579 A | | 6/1966 | Dills | |
| 3,333,085 A | | 7/1967 | Colatillo | |
| 3,358,122 A | | 12/1967 | Torrey | |
| 3,393,295 A | | 7/1968 | Jepson et al. | |
| 4,538,049 A | | 8/1985 | Ryckman, Jr. | |
| 4,849,595 A | * | 7/1989 | Fowler | 219/492 |
| 5,519,188 A | | 5/1996 | Yuichi et al. | |
| 5,534,678 A | * | 7/1996 | Bowles et al. | 219/396 |
| 5,662,465 A | * | 9/1997 | Kano | 219/412 |
| 6,079,401 A | * | 6/2000 | Alvord et al. | 219/398 |
| 6,337,469 B1 | * | 1/2002 | Chung | 219/506 |

* cited by examiner

*Primary Examiner*—Mark Paschall
(74) *Attorney, Agent, or Firm*—Maginot, Moore & Beck

(57) ABSTRACT

A system and method for controlling heater element operation in an oven includes a proportional heater signal generator that is mounted in associated with an oven operational mode switch. The signal generator operates in a sub-interval about a mode indicator to generate a proportional signal for controlling a heater element. The proportional signal may be used to alter the input voltage or timing control of the heater element.

20 Claims, 2 Drawing Sheets

SYSTEM AND METHOD FOR PROPORTIONAL CONTROL OF OVEN HEATING ELEMENTS

This application claims the benefit of prov. application 60/345,500 filed on Dec. 21, 2001.

FIELD OF THE INVENTION

This invention relates generally to controllers for ovens and, more particularly, to methods and systems for controlling the power radiated by heater elements in a single oven.

BACKGROUND OF THE INVENTION

Temperature controls in ovens are well known. Typically, two rotary switches are provided for oven control. One switch allows a user to select a operational mode for an oven, such as bake, broil, or time bake; and the other switch regulates the temperature of the oven. Detents are typically provided in cams or disks that are mounted to the shaft of a rotary switch for function selection. These detents provide tactile and auditory feedback that confirms the user has selected a particular function by aligning an index marker on the switch with a mode identifier located proximate the switch or vice versa. The mode identifier is typically indicia such as words that are printed along the circumference of a rotary mode selection switch. Alternatively, a pushbutton or membrane switch may be provided for each operational mode on the control panel of a cooking appliance. Depressing a switch activates the mode of operation identified by the indicia located proximate the switch. The temperature control is typically a rotary switch that may include a potentiometer that is operated by rotating the shaft to provide a continuously variable control signal that corresponds to a temperature range.

In most previously known ovens, two heater elements are disposed in the oven cavity. One heater element, sometimes called a baking element, is typically located proximate the floor of the oven cavity and a second heater element, sometimes called a broiler element, is typically located proximate the ceiling of the oven cavity. When the function selector is set to a baking mode, typically both heater elements are activated to quickly heat the air in the oven cavity to a temperature set on the temperature switch and then electrical power to the broiler element is removed. The operation of the heater elements is typically regulated by a thermostatic switch that has its regulation temperature set by the potentiometer of the temperature control. Electrical power may be selectively applied to the heater elements when the thermostatic switch is closed and the power source is decoupled from the heater elements when the switch opens at the regulation temperature. In response to the function selector being set to "Broil," the temperature selector is typically disabled and the upper heater element alone is operated at full power.

The dissipation of heat from the two heater elements has different effects upon food. The upper heater element has more of a direct effect upon the surface of a dish because most foods placed in an oven cavity are not covered. Thus, the pan bottom and sides insulate the food from the bottom heater element to some degree but the upper heater element may brown the top of an uncovered food more quickly. For this reason, some oven controls have been developed that alter the application of electrical power to the heating elements or that alter the electrical load that the heating elements present to the power source.

U.S. Pat. No. 3,393,295 to Jepson et al. discloses a cooking device having a proportional heater element control. The proportional control is provided by a circuit that couples one heating element of the device to the electrical power source during a portion of a time interval and then couples the other heating element to the power source for the remainder of the time interval. This alternating coupling of electrical power to the two heating elements occurs for each time interval during the entire time that the cooking device is operated for cooking food that is placed within the heating cavity. For example, if the time interval is set to one minute and the cooking device is operated for thirty minutes to cook some food item, the alternating coupling of the heater elements to the electrical source occurs during each of the thirty one minute intervals. The device of this patent does not have a mode switch as the position of the proportional control switch determines whether the device is operating in the frying mode (bottom element alone is continuously coupled to power), baking mode (both elements coupling to power in an alternating manner), or broiling mode (upper element alone is continuously coupled to power).

U.S. Pat. No. 4,538,049 to Ryckman, Jr. discloses a toaster oven that has two upper heating elements coupled together in series and two lower heating elements coupled together in series. The upper heating elements have the same resistance value and this value is less than the resistance value of the lower heating elements. The toaster oven also includes a mode selector switch that may be used to select a toast, baking, or broiling mode as well as a special bake mode switch. The special bake mode switch couples one of the upper heating elements to one of the lower heating elements in series while the other upper heating element is coupled to the other lower heating element in series. Thus, both series combinations equally divide the current and the increase in the resistance of the upper element leg reduces the power dissipated by the upper heating elements. Consequently, the power ratio between the upper and lower heating elements is reduced and the food may be cooked with less intense heat on the upper surface of the item.

The temperature control switch of U.S. Pat. No. 2,832,878 to Baird incorporates a variable resistor with the temperature control switch so the resistance in one leg of a Wheatstone bridge corresponds to a temperature setting on a dial mounted in association with the temperature control switch. This variable resistance alters the point of balance of the Wheatstone bridge to vary the operation of a relay that applies electrical power to the heating elements of an oven. However, the signal generated by the potentiometer does not change the proportion of time that an upper element is operated with respect to a lower heating element nor does it alter the level of power applied to either heating element.

However, the oven controls disclosed by these patents suffer from one or more of the following limitations. For one, the device of the '295 Patent does not provide the simultaneous operation of both heating elements. The repetitive coupling and decoupling of the heating elements during each occurrence of a timing interval of a baking period may cause arcing at the contacts and degrade the operational life of the coupling switch. Also, the repetitive application and removal of electrical power causes variations in the current required by the elements and may increase power consumption of the device. The proportional control circuit of the '295 Patent requires a complicated cam follower arrangement that is driven by a timing mechanism. Such electromechanical circuits are relatively expensive to manufacture. The provision of a special baking mode switch, such as the one disclosed in the '049 Patent, requires additional cost for the special mode switch and its incorporation in the electrical circuit of the cooking device. The special mode switch also fails to provide continuously variable variation in the contribution of the upper and lower heating elements to the heat generated for the oven cavity. Finally, the temperature control of the '878 Patent provides a continuously variable signal over a temperature range but it does not alter the contribution of heat in the oven cavity from the lower and upper heating elements.

Another limitation of previously known oven controls is the use of a special circuit that is coupled to only one input line and a neutral line to reduce the input voltage for the heater element from the line-to-line voltage. This mechanism not only requires an additional circuit but it also only provides one alternative voltage setting for operation of the upper heater element.

What is needed is a system and method for operating two heater elements in an oven at different rates or power levels within one or more operational modes that may be selected by a control switch on an oven panel.

What is needed is a system and method for providing continuously variable control over the power level or rate of operation of two heater elements in an oven without using complicated electromechanical circuits and devices.

What is needed is a system and method for operating two heater elements in a cooking device without requiring the elements to be operated in a mutually exclusive manner.

SUMMARY OF THE INVENTION

The above-noted limitations of previously known oven controls have been overcome by a system and method made in accordance with the principles of the present invention. The system of the present invention is comprised of a proportional heater element signal generator and an oven operational mode selection switch with mode indicators that identify operational modes for an oven. The proportional heater element signal generator operates in association with the oven operational mode switch to generate a proportional heater element control signal. The proportional heater element control signal may correspond to a position of the mode selection switch within a sub-interval of the oven operational mode switch. Alternatively, the proportional heater element signal generator may generate a signal that corresponds to a graphical or numerical element that may be set by a user.

The position of the mode selection indicator within the sub-interval identifies a proportion of heat contribution for one of the heater elements. For example, the mode selection indicator may be positioned at a location that corresponds to one fourth of the length of the sub-interval. In response, the signal generated by the proportional heater element signal generator is one fourth of its maximum magnitude. When the proportional heater element signal generator is a potentiometer or a wiper mounted to the shaft of the mode switch that engages a resistor located in an arc that corresponds to a mode indicator, the signal is a voltage drop across an electrical resistance that is determine by the potentiometer or wiper position in the sub-interval. In response to this signal, for example, the heater element may be operated for one fourth of some time period or at one fourth of the maximum power level for the mode identified by the mode selection indicator.

For example, the resistance defined by a particular position of the potentiometer or the point of contact of the wiper with a resistor may be provided as one resistor of a voltage divider at the power input to the burner selected for proportional control. By varying the resistance in the voltage divider, the voltage across the selected burner is also altered in proportion to the resistor value change. Thus, the signal may be a continuously variable one over the range of the resistor's value. Preferably, a fixed value resistor is provided in the divider leg of the resistor so a negligible voltage remains across the burner that is connected in parallel with the variable resistor.

In another embodiment of the invention, the proportional heater element signal generator may be a variable voltage or current source that generates a voltage or current signal that corresponds to the position at which the mode selection indicator is located in the range of movement for the mode selection switch within the sub-interval about one of the mode indicators proximate the switch.

The operation of the oven is performed in accordance with the proportional heater element signal and the selected mode. For example, when the mode selection indicator is placed within the sub-interval about the indicia for the baking mode, the lower element may continuously supply heat and the proportional heater element signal may be used to alter the operation of the upper heater element. When the mode selection indicator is moved to the indicia corresponding to the broiling mode, the lower heater element remains off and the proportional heater element signal alters the operation of the upper heater element. Thus, the operation of the lower heater element in these two modes corresponds to the selected mode while the operation of the upper heater element corresponds to the proportional heater element signal. In another mode, such as one identified by indicia for pastry cooking, the upper heater element may remain off while the lower heater element operation corresponds to the proportional heater element signal. Consequently, both mode selection and the proportional heater element signal control operation of the heater elements.

In one aspect of the present invention, the proportional heater element signal is provided to a microcontroller, microcomputer, or application specific integrated circuit (ASIC) so timing or power input control of a heater element may be performed. In response to the signal, the controlling device may alter the level of input power to a heater element or it may change the length of time during which power may be applied to a heater element. The controlling device also responds to the mode selection to operate the other heater element in accordance with the parameters of the selected mode.

In another embodiment of the present invention, the mode selection switch may be a linear potentiometer with a slide switch that may traverse the length of the potentiometer. A knob or other actuator may be mounted to a shaft extending from the potentiometer and marked with an index pointer to visually aid a user in identifying the mode selected by moving the actuator along the length of the potentiometer's movement range. As long as the actuator remains within a sub-interval about some mode indicator identifying a mode that may be provided proximate the slot in which the actuator travels, the corresponding mode determines which heater element responds to the proportional heater element signal. Likewise, the position of the actuator within the sub-interval determines a characteristic of the proportional heater element signal such as its magnitude or the like. Thus, once the actuator is within the sub-interval about a mode indicator, the operation of the heater elements is defined by the selected mode and the position of the actuator within the sub-interval determines the signal generated by the proportional heater element signal generator. In this embodiment, the operational mode selector and proportional heater element signal generator are integrated into the linear potentiometer. The signal from the linear potentiometer may be used to identify the operational mode for the oven as well as determining the proportional operation of one of the heater elements.

In a digitally controlled oven, a rectified and stepped-down voltage may be provided across a variable resistance determined by a position within the sub-interval about a mode indicator to generate a proportional control signal for a burner. This signal may be converted to a digital value and provided to an oven heater element controller that alters the input power for one of the oven heater elements. Alternatively, the controller may selectively couple one of the heater elements to input power in accordance with a timing cycle that alters the contribution of the heater element to the heat contained in the oven for the selected mode. For independent control of the heater elements, the controller may generate a control signal for the other heater element that is the reciprocal of the proportional signal. For example, a proportional signal that causes the controller to reduce power to one heater element to a value of approximately 30% of the line voltage may cause the controller to couple 70% of the line voltage to the other heater element. In another embodiment, the controller may operate one heater element 30% of the time for a heating cycle while operating the other heater element at 70% of the time for the cycle.

A method implementing the principles of the present invention identifies an operational mode for an oven and generates a proportional heater element control signal that corresponds to a position in a sub-interval associated with the identified oven operational mode. The generation of the proportional heater element signal may correspond to a variable resistance, voltage, or current. The variable resistance may be used to vary the input power for one of the oven heater elements. Alternatively, the variable resistance, voltage, or current may be provided to a digital controller so it may control the operation of a heater element in accordance with the proportional signal. The operation control may include varying the input power to one or more heater elements of the oven. Alternatively, the digital controller may control the time that power is applied to one or more heater elements in accordance with the proportional signal. Mode selection identification is also used to identify which heater element is under proportional control and the operational conditions for the other heater element.

The system and method of the present invention provide proportional control of a heater element in an oven without requiring an additional switch in the panel of the oven. Furthermore, the system and method of the present invention take advantage of the components already in a conventional oven to implement the proportionality control of the present invention. Also, the system and method of the present invention may be used to provide continuously variable control over the range of the proportional heater element signal generator. The system and method of the present invention implement proportional control without requiring that only one heater element operate at a time. The system and method of the present invention may also be used to provide more than two input voltages or timing cycles for control of a heater element.

These and other advantages and features of the present invention may be discerned from reviewing the accompanying drawings and the detailed description of the invention.

BRIEF DESCRIPTION OF THE DRAWINGS

The present invention may take form in various components and arrangement of components and in various methods. The drawings are only for purposes of illustrating exemplary embodiments and alternatives and are not to be construed as limiting the invention.

DETAILED DESCRIPTION OF THE INVENTION

Figure 1:
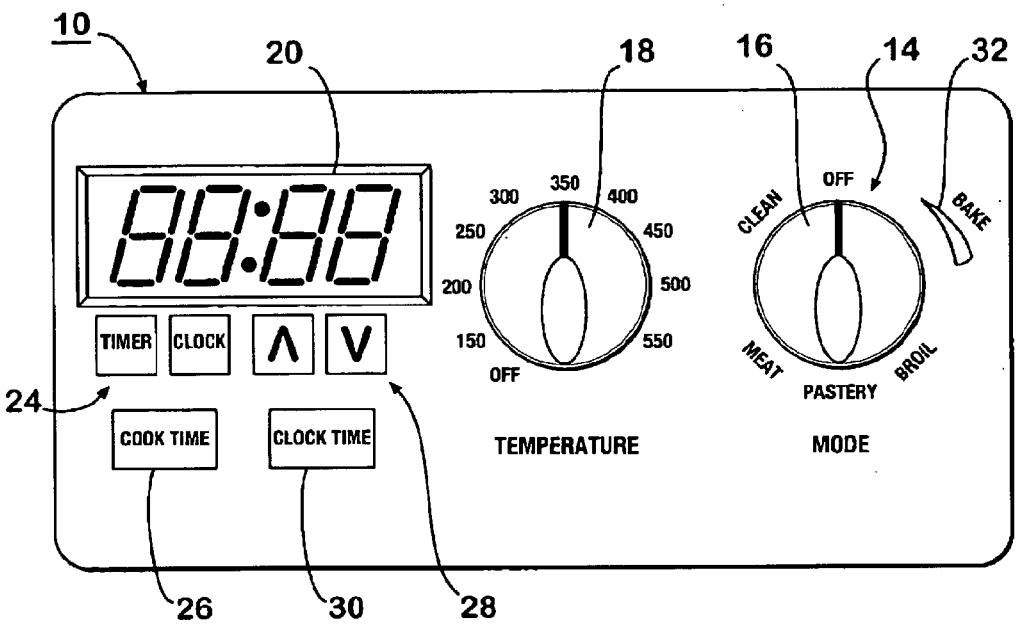
FIG. 1 depicts a control panel of an oven in which the system of the present invention may be implemented.

A control panel 10, such as the one shown in FIG. 1, may be any such control panel used in conjunction with an oven having a digital controller although such a panel and display may be used with conventional ovens as well. Control panel 10 includes an oven operational mode switch 14 that has an index bar 16. Index bar 16 may be used to align switch 14 with an indicator identifying an operational mode for the oven such as "Bake," "Broil," and the like as indicated in the figure. Control panel 10 may also include a temperature control switch 18 that also has an index bar for alignment with temperature indicating indicia. A digital display 20 may be used to display time of day or timer data. The value displayed in unit 20 may be determined by display mode switches 24 that couple display 20 with time of day values when the clock switch is depressed and with time remaining when the timer switch is depressed. For timed cooking modes, cooking time switch 26 may be depressed so total time for cooking may be entered using up/down switches 28. Switch 30 may be depressed in any timer or cooking time mode to terminate countdown operation and couple display 20 to time of day values. Typically, such a control panel is mounted on the back splash of an oven in a known manner. Although display unit 20 is shown as a digital unit, the system and method of the present invention may be implemented with known analog units as well.

Also shown in FIG. 1 is a sub-interval indicator 32. Sub-interval indicator 32 is shown as a tapered, arcurate bar that subtends a portion of the range of movement that may be swept by index bar 16 as switch 14 is rotated for a revolution. However, other sub-interval indicators may be used with mode selectors to identify a sub-interval. For example, color gradations or a triangle may be used to indicate the progression from a low proportion to a larger proportion. Index bar 16 and sub-interval indicator 32 cooperate to define a sub-interval for the mode identified by the mode indicator proximate sub-interval indicator 32. Specifically, movement of switch 14 so index bar 16 points towards sub-interval indicator 32 results in the oven operating in the mode associated with sub-interval indicator 32 and in the generation of a proportional heater element signal.

Figure 2:
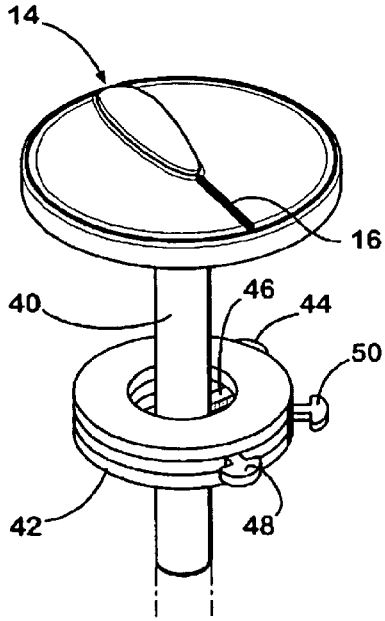
FIG. 2 is an exemplary embodiment of a potentiometer as a proportional heater element control signal generator used in the oven shown in FIG. 1.

A proportional heater element signal generator may be mounted in association with a shaft that extends from switch 14 as shown in FIG. 2. Shaft 40 of mode switch 14 extends through a potentiometer 42 so a protuberance 46 of shaft 40 engages a movable slide (not shown) of potentiometer 42. Potentiometer 42 has three terminals 44, 48, 50 that may be used to define a voltage divider. The resistance between 44 and 48 defines the maximum, fixed resistance of potentiometer 42 and a variable resistance value between terminal 44 and 50 is determined by the position of the movable slide.

Figure 3:
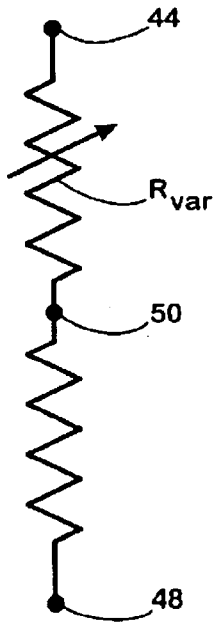
FIG. 3 is an electrical schematic diagram for the potentiometer shown in FIG. 2.

A schematic of the electrical circuit defined by potentiometer 42 is shown in FIG. 3. The value of the variable resistance at the lower end of its range is typically some small value so a minute voltage drop may be detected across the variable resistance. As the variable resistance increases to a value that approaches the maximum resistance value, one half of the voltage dropped across potentiometer 42 is dropped across the variable resistor. Thus, applying a voltage across potentiometer 42 and sensing the voltage across terminals 44 and 50 provides a signal that is proportional to the movement of the movable slide caused by its engagement with protuberance 46. Preferably, as shaft 40 of switch 14 is rotated to a position beyond either end of sub-interval indicator 32, protuberance 46 disengages the movable slide of potentiometer 42 and the movable slide returns to the position where the smallest resistance is between terminals 44 and 50. Consequently, the voltage sensed across terminals 44 and 50 not only indicates the proportionality control but also whether the mode associated with the sub-interval has been selected. That is, once the voltage drop between these two terminals is slightly greater than the voltage drop across terminals 44 and 50 when protuberance 46 does not engage the movable slide, a signal indicating that switch 14 has been moved to select the operational mode of the sub-interval is generated. When the signal stabilizes at some voltage between the negligible voltage and one half of the voltage dropped across terminals 44 and 48, the proportional heater element signal is generated. Alternatively, mode selection may be implemented by mounting cams or other known engagement structures about shaft 40 so they may contact switches that activate oven operational modes in a known manner.

Figure 4:
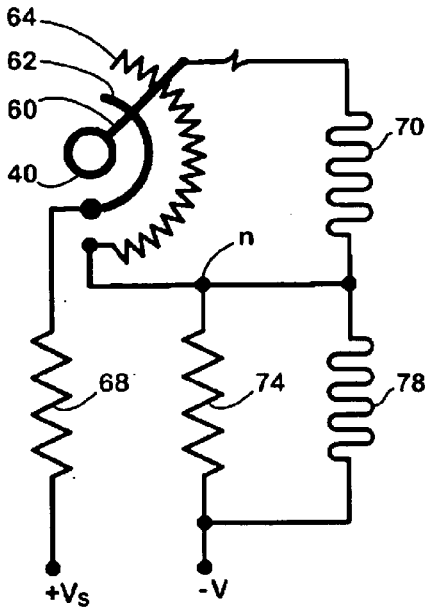
FIG. 4 is an exemplary embodiment of a wiper/resistor combination that may be used as a proportional signal generator in the oven of FIG. 1.

The signal generated by a proportional heater element signal generator such as potentiometer 42 may be provided to a microcontroller, microcomputer, or application specific integrated circuit (ASIC) so control may be performed with respect to a heater element. For more directly controlling the input voltage to a heater element, a wiper 60 may be mounted to shaft 40 so it sweeps across a resistor 64 when it subtends an arc in the vicinity of a mode indicator as shown in FIG. 4. A fixed resistor 68 may be in series connection with one end of conductor 62. Coupled in a parallel manner to resistor 64 and 68 is a heater element 70. The terminal ends of resistor 64 and heater element 70 are coupled at node n to a resistor 74 and heater element 78 that are arranged in a parallel circuit.

When a user rotates mode switch 14 so index bar 16 aligns with some portion of sub-interval indicator 32 underlining the "Bake" indicia, for example, wiper 60 electrically couples resistor 64 to the supply voltage through conductor 62 and resistor 68. The distance between the point of contact on resistor 64 and its terminal end determines the amount of resistance placed across heater element 70. Fixed resistor 68 is provided to prevent the value of the resistance from being zero but its value is negligible compared to resistor 64. In this manner, the line voltage applied at the input is dropped across the voltage divider that is comprised of the resistors 64 and 68 in the upper leg and resistor 74 in the lower leg. As the resistance value for resistor 64 is reduced by moving wiper 60 toward the terminal end of resistor 64, most of the voltage drop occurs across resistor 74. Consequently, heater element 78 dissipates more power and contributes more heat to the oven than heater element 70. A thermostatic switch (not shown) may be included at the terminal end of resistor 74 and heater element 78 to maintain the temperature selected by temperature control switch 18 in a known manner.

As may be ascertained from the description of the potentiometer and wiper/resistor combination, the proportional heater element signal generated by the present invention may be substantially continuous. Consequently, the input voltage for one heater element may be set to a level of 0% to 100% of the maximum input voltage without altering the input voltage for the other heater element in the selected mode of operation. Likewise, the percentage of time that an element may be operated over a timing cycle may be set from 0% to 100% without altering the timing control of the other element for the selected mode of operation. The system of the present invention is not unduly burdensome for the manufacture of ovens as it only requires the mounting of a potentiometer or wiper/resistor combination in association with the shaft of switch 14. The integrated mode selection and proportionality control using a variable resistor may also be implemented with a linear potentiometer. Other proportional signal generators may be used such as optical and magnetic proximity devices provided they generate a signal having a level or intensity that corresponds to the degree of a sub-interval associated with a mode indicator. Such signals may be used to regulate the voltage drop or current flow through one or more heater elements in the oven. Alternatively, a plurality of discrete points in the sub-interval may be used so a heater element may be controlled at more than one or two levels of operation in the mode corresponding to the sub-interval without providing a continuously variable control signal.

Figure 5:
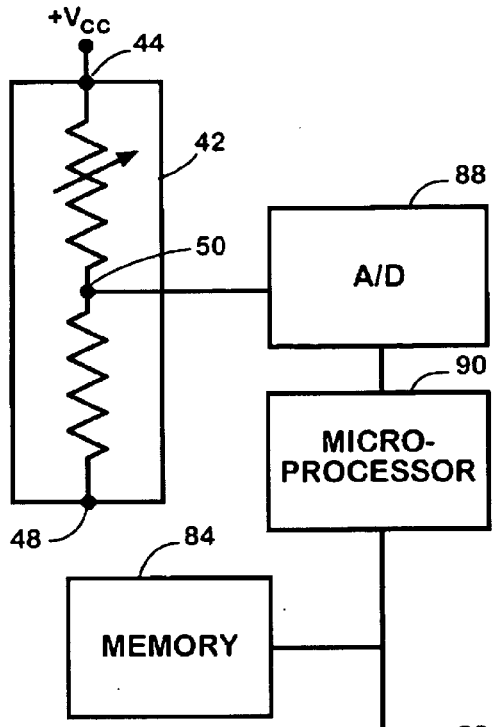
FIG. 5 is a block diagram of an embodiment of the present invention that uses a digital controller.

In ovens that include a digital controller, an implementation of the present invention may include circuitry such as that shown in FIG. 5. The digital electronics are typically powered by a voltage Vcc that is derived from the line voltage supplied to the oven. This voltage may be applied to potentiometer 42 mounted to shaft 40 of switch 14 as described above to generate a signal at terminal 50. The level of the signal available at terminal 50 depends on the position of the movable slide in response to index bar 14 being moved through a sub-interval associated with a mode indicator. The signal may be converted by an analog/digital converter 88 to a digital value that may be provided through known interface circuitry to a digital controller 90. Under program control stored in memory 84, controller 90 may alter the voltage or current operation of one or more heater elements in the oven by controlling relays, switches, or power supplies through oven control interface 86 in known manner. For example, controller 90 may operate switches to route the input line voltage through a step down transformer to reduce the power available for dissipation by a heater element. In an alternative embodiment, controller 90 may compute a reciprocal value that may be used to control another heater element in the oven. For example, controller 90 may activate the heater elements for one minute and then disable power for ten seconds before reapplying power for one minute. When a proportional voltage is read that is 30% of the expected voltage range for the voltage input to converter 88, controller 90 may alter its control and activate one heater element for 18 seconds (30% of 60 seconds) and the other heater element for 42 seconds (70% of 60 seconds). If the heater element operated at the 30% rate is the upper heater element in an oven, less browning of the food in the oven occurs. Also, this manner of control permits two or more heater elements to be controlled at different rates or levels from only one proportional signal.

Controller 90 may perform continuously variable control based upon the voltage values generated by converter 88 over the voltage range drop expected from the voltage divider. Alternatively, a range of voltage values may be mapped to a single proportional value so the expected voltage range drop may correspond to a discrete number of proportional control values. Controller 90 may use these proportional control values to generate reciprocal values and effect control over multiple heater elements in the oven.

Another embodiment of the present invention may take advantage of digital display 20 and up/down switches 28 as shown in FIG. 1. In this embodiment, switch 14 is used in a known manner to select a operational mode of operation for the oven so a mode selection signal is provided to a digital controller through interface 86. Alternatively, push-button or membrane switches that correspond to different operational modes may be provided in a control panel so that depression of one of the switches generates a mode selection signal that may be provided to controller 90 through interface 86. In response to the digital controller detecting the selection of an operational mode having an associated sub-interval, the digital controller displays sub-interval indicia, such as a horizontal bar, in display 20 with an indicator of its meaning. For example, a horizontal bar may be accompanied by the words "Upper Element Intensity." A user may then use the up/down switches 28 to make the displayed bar longer or shorter under the control of the digital controller in a known manner. After each depression of an up/down switch, a timeout period may be commenced and, upon expiration of the timeout period, a proportional heater element signal corresponding to the displayed sub-interval indicia may be generated. For example, the length of a displayed bar may be used to define a proportional heater element control signal for a digital controller. In this example, the controller may use a default value to generate the displayed bar and depressions of up/down switches 28 may be used to increase/decrease this value. Upon timeout, the modified default value may be used to define a proportional heater element control signal. The signal value corresponding to the displayed bar length may be used as described above to alter the input voltage for a heater element or the timing of its operation. In yet another embodiment of the present invention, a digital controller may display two horizontal bars, one of which corresponds to the upper element and one of which corresponds to the lower element. The user may then set the proportions for the operation of each heater element. Of course, other graphical or numerical displays may be used for providing visual feedback to a user regarding adjustment to the operation of one or more heater elements in a sub-interval about a selected mode of operation.

Figure 6:
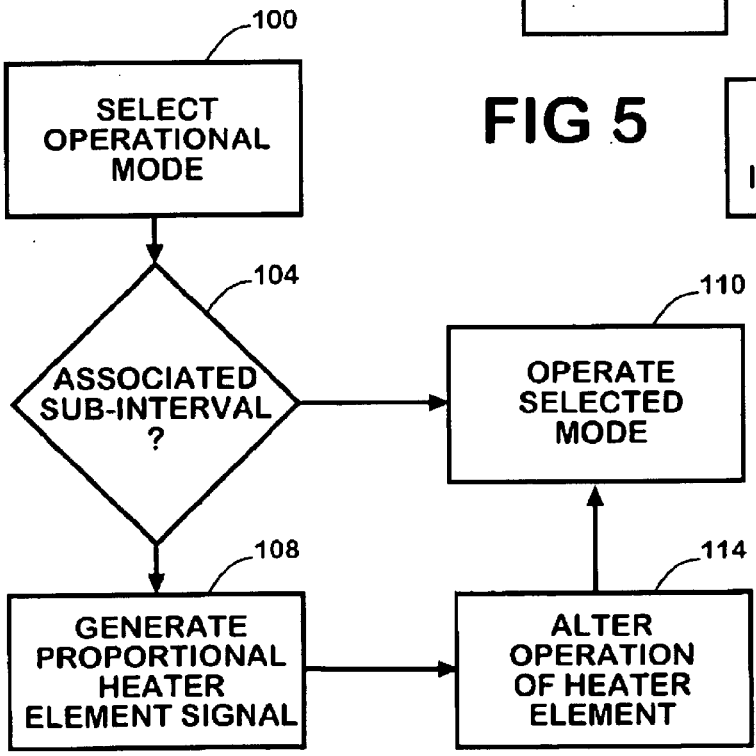
FIG. 6 is a flow diagram of an exemplary method that may be used to implement the present invention.

An exemplary method for implementing the present invention may be described with reference to the flow diagram shown in FIG. 6. The method may include selecting an operational mode for the oven (block 100). In response to the selected mode being one having an associated sub-interval (block 104), a proportional heater element signal is generated (block 108). Otherwise, the oven is operated in the selected mode without proportionality control (block 110). The proportional heater element signal corresponds to a position within a sub-interval about a selected mode of operation. The proportional heater element signal may be used to alter the operation of one or more heater elements in accordance with the selected mode (block 114). The operation control may include varying the input power to one or more heater elements of the oven. Alternatively, operational control may alter the timing for applying power to one or more of the heater elements in accordance with the proportional signal. Mode selection identification may also be used to identify which heater element is under proportional control and the operational conditions for the other heater element. The other element may be operated in accordance with the selected mode (block 110). Changes made at the proportional heater element control signal generator while the oven is operating in a mode having an associated sub-interval may be provided to control circuitry, such as controller 90, on an interrupt basis. Alternatively, the control circuitry may periodically or occasionally poll the proportional heater element control signal generator to determine whether the control signal has changed. In the circuit shown in FIG. 4, movement of wiper 60 causes a change in the input voltage to the heater element.

The proportional heater element signal may be generated by one or more of the embodiments described above. Also, the proportional heater element signal generator may be mounted proximately to the operational mode switch so it detects movement of the switch within a sub-interval about one of the mode indicators for the switch. For example, a magnetic or optical sensor mounted in spaced apart relation from shaft 44 of a operational mode switch may be used to generate a proportional signal according to its detection of a metallic member or the like extending from the shaft. Likewise, a conductor or magnetic element may be provided beneath index bar 16 on the knob at the end of shaft 40 and a sensor located on control panel 10 proximate to one of the mode indicators but under the knob. The sensor would generate a proportional signal from the strength of the magnetic field detected as the magnetic element came within the area of the sensor in response to the index bar being moved to a point within a sub-interval about the mode indicators associated with the sensor.

In operation, a system of the present invention may be incorporated on the shaft of a operational mode switch of an oven or one located in proximity of a mode indicator associated with the operational mode switch. In response to the mode identified by the associated indicia being activated, a proportional signal is generated and used to control an operational parameter of a heater element. The operational elements include the voltage or time of operation of the element. The proportional signal may be continuously variable or a plurality of discrete points may be used for control of the heater element. The system of the present invention may be used with more than one mode that may be activated by a operational mode switch by incorporating other proportional signal generators with associated modes. For example, additional potentiometers may be mounted at positions so that a protuberance from the shaft of a operational mode switch engages the movable slide of a potentiometer when the mode selection switch is rotated through a sub-interval associated with mode indicia. The method of the present invention may be implemented in software that executes in the memory of a microcomputer. For digital implementations, the proportional heater element signal may be generated by a device that generates the signal in response to the rotation of the mode selection switch. Alternatively, the proportional heater element signal may be generated by a user's interaction with a graphical or numerical display under the control of a controller. The user's interaction may establish a displayed value that may be used by a controller to control heater element operation.

While the present invention has been illustrated by the description of exemplary embodiments and processes, and while the various embodiments and processes have been described in considerable detail, it is not the intention of the applicant to restrict or in any limit the scope of the appended claims to such detail. For example, while the various embodiments and methods have been described with reference to measuring resistance or voltages altered by changing resistance, one skilled in the art should recognize that other electrical parameters, such as inductance or capacitance, may be used. Other advantages and modifications will readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for controlling heater elements in an oven comprising:

an oven operational mode selection switch located proximate a plurality of mode indicators that identify oven operational modes, the oven operational mode selection switch being used to select one of the operational modes identified by the mode indicators; and a proportional heater signal generator that operates in association with the oven functional mode switch to generate a proportional heater element control signal that corresponds to a position proximate the oven functional mode selection switch within a sub-interval associated with one of the mode indicators that identify an oven operational mode so that operation of a first burner of an oven to continuously supply heat is controlled by the mode selected by the mode selection switch and the operation of a second burner of the oven is altered by the control signal generated by the proportional heater signal generator whereby proportional control of one burner of the oven during a selected mode of oven operation is achieved.

2. The system of claim 1, the proportional heater element control signal generator further comprising:

a wiper mounted to a shaft of the oven functional switch; and a resistor that engages the wiper as the shaft of the oven functional switch rotates within the sub-interval to provide proportional control for the second burner of the oven.

3. The system of claim 1, the proportional heater element control signal generator further comprising:

a potentiometer mounted in association with the oven operational mode selection switch so that movement of the switch within the sub-interval varies a resistance of the potentiometer to provide proportional control for the second burner of the oven.

4. The system of claim 1, the proportional heater element control signal generator further comprising:

a variable voltage source mounted in association with the oven operational mode selection switch so that movement of the switch within the sub-interval varies an output voltage of the voltage source to provide proportional control for the second burner of the oven.

5. The system of claim 1 further comprising:

a controller that is operatively coupled to the proportional heater element control signal generator so that the controller may alter the operation of the second heater element in accordance with the proportional heater element control signal received from the proportional heater element control signal generator while the first burner continuously supplies heat in correspondence with the mode selected by the mode selection switch.

6. The system of claim 5 wherein the controller alters an input voltage to the second heater element to provide proportional control of the second heater element.

7. The system of claim 5 wherein the controller alters timing control of the second heater element to provide proportional control of the second heater element.

8. The system of claim 5 wherein the controller is a microcontroller, a microcomputer, or an application specific integrated circuit.

9. A system for controlling heater elements in an oven comprising:

an oven operational mode selection switch located proximate a plurality of mode indicators that identify operational modes for an oven, the oven operational mode selector switch being used to select one of the operational modes identified by the mode indicators;

a proportional heater element control signal generator that operates in association with the oven operational mode selection switch to generate a proportional heater element control signal that corresponds to a position within a displayed sub-interval indicia associated with one of the mode indicators that identify an oven operational mode so that the operation of a first burner of an oven to continuously supply heat corresponds to the mode selected by the oven operational mode selection switch and the operation of at least one other burner of the oven is altered by the proportional heater element control signal.

10. The system of claim 9 further comprising:

a controller operatively coupled to the proportional heater element control signal generator so that the controller may alter the operation of the other heater element in accordance with the proportional heater element control signal received from the proportional heater element control signal generator.

11. The system of claim 10 wherein the controller alters an input voltage to the other heater element.

12. The system of claim 10 wherein the controller alters timing control of the other heater element.

13. The system of claim 10 wherein the controller is a microcontroller, a microcomputer, or an application specific integrated circuit.

14. A method for proportionally controlling operation of a heater element in an oven comprising:

selecting an operational mode of an oven for control of a first heater element in an oven to continuously supply heat;

generating a proportional heater element control signal that corresponds to a position in a sub-interval associated with the selected operational mode; and altering the operation of at least one other heater element in the oven in correspondence with the proportional heater element control signal.

15. The method of claim 14, the signal generation further comprising:

varying an electrical resistance in accordance with the position in the sub-interval associated with the selected operational mode.

16. The method of claim 14, the signal generation further comprising:

varying a sub-interval indicia on a display.

17. The method of claim 14 further comprising:

altering the operation of the one other heater element in a baking mode to alter the browning operation of the oven.

18. The method of claim 17, the one other heater element alteration further comprising:

altering an input voltage to the one other heater element.

19. The method of claim 17, the one other heater element alteration further comprising:

altering operational timing of the one other heater element.

20. The method of claim 14 wherein said proportional signal generation generates a discrete signal for altering operation of the at least one other heater element.

* * * * *